United States Patent [19]

Downing

[11] 4,257,140

[45] Mar. 24, 1981

[54] PAINTING DEVICE

[75] Inventor: Stephen B. Downing, High Wycombe, England

[73] Assignee: Imperial Chemical Industries Limited, London, England

[21] Appl. No.: 30,526

[22] Filed: Apr. 16, 1979

[30] Foreign Application Priority Data

Apr. 28, 1978 [GB] United Kingdom ..... 16946/78

[51] Int. Cl.[3] ..... B05C 17/02

[52] U.S. Cl. ..... 15/230.11; 29/110.5

[58] Field of Search ..... 15/230.11; 29/110, 110.5; 101/134; 401/218; D4/38.1

[56] References Cited

U.S. PATENT DOCUMENTS

| | | | |
|---|---|---|---|
| D. 173,162 | 10/1954 | Knapp | D4/38.1 |
| D. 173,312 | 10/1954 | Knapp | D4/38.1 |
| 2,805,436 | 9/1957 | Christensen | 401/218 X |
| 3,090,301 | 5/1963 | Arounowa | 29/110.5 X |

FOREIGN PATENT DOCUMENTS

| | | | |
|---|---|---|---|
| 407935 | 10/1970 | Australia | 401/218 |
| 241595 | 10/1925 | United Kingdom | 15/230.11 |
| 1144858 | 3/1969 | United Kingdom | 15/230.11 |

*Primary Examiner*—Edward J. McCarthy

*Attorney, Agent, or Firm*—Cushman, Darby & Cushman

[57] ABSTRACT

A conventional roller-type paint applicator, having a head surfaced with a paint-retentive material, is modified for use with a thickened paint to produce a textured pattern on a substrate by a sleeve which fits over the existing head. The sleeve, optionally in conjunction with the existing surface of the head, defines a plurality of receptacles for thickened paint which are arranged to determine a desired pattern of paint on a substrate.

14 Claims, 1 Drawing Figure

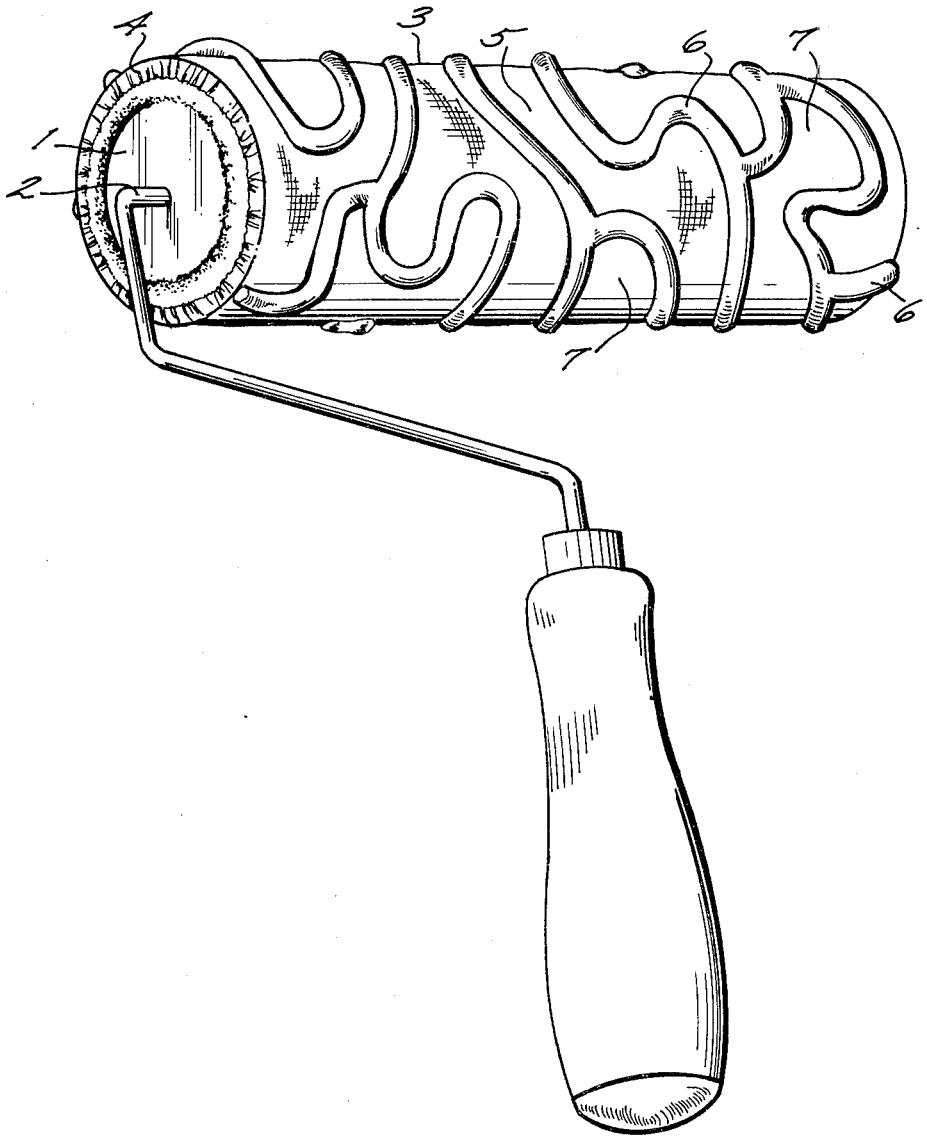
4
3
5
6
7
1
2
7
6

PAINTING DEVICE

This invention relates to the modification of conventional roller-type applicators for paints.

Paints, particularly water-based decorative paints, are commonly applied to walls or to other relatively flat substrates using a roller-type applicator. The conventional type of applicator comprises a cylindrical or similarly shaped applicator head which is rotatable about its main axis and has an outer surface of lambswool, simulated lambswool, cellular material or other paint-retentive material. Paint is taken up on the surface of the roller head from a suitable paint reservoir and the paint is then transferred to and evenly spread over a substrate to be painted. It is known to provide replacement heads suitable for use with these roller applicators such that the new head provides a new outer surface of lambswool, simulated lambswool or the like when the original surface has become unsatisfactory for use. Certain special roller applicators have also been devised in which the head comprises an outer cellular or similar surface which has been grooved or indented to enable the production of a patterned coating.

It is frequently desired to produce a textured or patterned effect on a substrate such as a wall or ceiling. Broadly, two types of paint may be used to achieve this effect; (a) that type which contains coarse materials such as sand, marble chips or wood chips; and (b) that type which is substantially free from coarse material but which has a modified rheology. Both types of paint are higher in viscosity than conventional decorative paints. Whilst roller applicators of the conventional type described above are suitable for use with conventional decorative paints to produce non-textured coatings, and may be suitable also for use with the type (a) paints to produce textured coatings, they are not very suitable for use with the type (b) paints. Those roller applicators mentioned above having a head which is grooved or indented to produce a patterned coating are suitable for the type (a) paints, but are not very suitable for use with the type (b) paints or with conventional decorative paints. Moreover these prior patterned applicators are capable of producing only one type of pattern.

According to this invention we provide a method of modifying a paint roller applicator of the conventional type hereinabove described wherein there is fitted to the head of said roller applicator, in a manner which permits easy removal therefrom, a sleeve;

(i) the sleeve when fitted to said roller head defining, either by itself or in conjunction with the roller head and when in use, a plurality of receptacles for thickened paint; and (ii) the arrangement of the receptacles in the sleeve predetermining the pattern of a thickened paint coating which is applied to a substrate.

Thus the sleeve is fitted over the surface of lambswool, simulated lambswool or other surface which is present on the conventional roller applicator head. The sleeve may be, for example, a slide or stretch fit on the applicator head; and it may be temporarily retained on the head, for example, by the presence of constricted and/or elasticated ends or by tie strings at one or at each end of the sleeve, so that the sleeve may be easily removed when required. Removal of the sleeve will expose the original surface of the roller head when this is desired for use with conventional paints; alternatively a sleeve which will produce a different pattern of a thickened paint coating may be fitted. Whilst the sleeve is usually of tubular form both before and after fitting to the applicator head the sleeve may be in an opened-out form which can be subsequently wrapped around the applicator head and caused to remain in that position for example, by using a temporary fastener, for example a "Velcro"-type material.

The invention also provides a sleeve for use in the above method which is adapted to be fitted to, and to be easily removed from, the head of a conventional roller-type paint applicator of the type herein described, the sleeve when fitted to said head, either by itself or in conjunction with the roller head and when in use, defining a plurality of receptacles for thickened paint which are arranged to predetermine a desired pattern of a thickened paint coating produced on a substrate.

The invention also provides a set of such sleeves for use in conjunction with a conventional roller-type paint applicator of the type herein described, each sleeve when fitted to the applicator head and in use defining a plurality of receptacles for thickened paint which are arranged to predetermine a desired pattern on a substrate which is different from that pattern which is produced by another sleeve in the set.

The present invention is particularly relevant to conventional roller-type paint applicators wherein the head is externally loaded from a reservoir of thickened paint.

By a thickened paint we mean a paint which has a significantly higher viscosity than the conventional paints which are usually used to produce essentially smooth non-textured decorative finishes. A typical thickened water-based paint, for example, will usually contain a synthetic latex binder (e.g. a vinyl or acrylic polymer), prime pigments and extenders, and a water-soluble polymeric thickener. The low shear rate viscosity (as measured by the ICI Rotothinner Viscometer) for a conventional emulsion paint will usually be of the order of 3–8 poise; whereas the low shear rate viscosity of a thickened paint suitable to be used in the present invention will be of the order of 10–50 poise.

The sleeve may be perforated, by which term it is meant that the sleeve has a plurality of perforations or holes which penetrate the entire thickness of the sleeve. The perforations or holes may be formed in the material of which the sleeve is comprised during the manufacture of the material, for example during a knitting, crocheting or other process of making an "open-weave" type of material as opposed to a typical textile fabric in which there may be holes of maximum width say 1/16". Alternatively, the perforations or holes may be produced in the sleeve material after its manufacture, for example by a piercing or a punching process. Preferably the perforations have a minimum width of $\frac{1}{8}$" and more preferably a minimum width of $\frac{1}{4}$".

Particularly suitable perforated sleeves include those sleeves which are made by a weaving, knitting, crocheting, netting, expanding or other process which produces a very open weave, open mesh or similar perforated material. These sleeves may be made from natural or synthetic fibrous textile material or from plastics material. Other particularly suitable perforated sleeves are made by forming holes in a cylinder of plastics material, for example of PVC.

When a perforated sleeve is fitted to a conventional roller head having a lambswool, simulated lambswool, cellular or other type of surface, that surface will define and form the base of the receptacles for, and will be in contact with, the thickened paint. The cross-section of the receptacles will be defined by the shape of the perforations in the sleeve.

A backing may be provided in the construction of the sleeve and in such a case the backing together with another component of the sleeve attached to or formed with the backing will provide the receptacles for paint when in use.

For example, the sleeve may comprise a textile fabric backing, for example a conventional tubular bandage or canvas material, or a backing of plastics, rubber or similar material, to which is attached or with which is formed another component of the sleeve in order to define suitable receptacles for paint. For example, a convolution or other configuration of cord or other receptacle-defining material of substantial thickness, say at least $\frac{1}{8}$" thick, may be attached to the textile backing. Thus a length or lengths of the cord which is attached to the backing may define on the textile backing a series of distinct shapes or a random pattern which provides suitable receptacles for the thickened paint. The cord or other receptacle-defining material may be of natural or synthetic fibre or of plastics or rubber material. Textile backing and cord of a major proportion of a natural fibre such as cotton is particularly suitable. Short discreet lengths of cord may also be attached to a backing as in a process of making rugs or "Candlewick" (Registered Trade Mark)-type materials.

The sleeve *per se,* when not attached to the applicator head, may be permanently and substantially tubular in shape, or it may be somewhat limp and capable of being formed into a substantially cylindrical shape when fitted to a roller head.

It will now be clear that in referring to 'receptacles for thickened paint' we mean, broadly, that, when attached to the applicator head the surface of the sleeve comprises distrinct regions, which may be interconnecting or not, into which the thickened paint is loaded from a suitable paint reservoir and from which the paint is expressed onto a substrate during roller action, and which are sufficiently large to form a distinct pattern.

Conventional paint rollers modified by a sleeve of the type herein described are eminently suitable for applying thickened paints, especially those paints of type (b) described above. Besides having the advantage of being able to temporarily convert a wide range of conventional paint rollers into a specialised tool, the plurality of receptacles introduced into the surface of the roller head (when in use) by the sleeve, either by itself or in combination with the original surface of the roller head, are helpful in increasing the amount of paint that can be taken up on to the roller head and transferred to the substrate for each separate loading of the roller. The average thickness of a paint coating derived from a thickened paint is several times that of a conventional decorative paint. It is important that the paint held in the receptaclesallows a thick, liquid film of paint to be formed where the roller head is in contact with the substrate being painted, and the ability to produce patterns in the final paint coating appears to involve the "splitting" of this liquid film as the roller passes over the substrate being painted. Thicker films generally give higher peaks or relief. By arranging the receptacles into a regular or irregular pattern, a predetermined pattern of peaks, ridges etc. can be produced in the liquid paint coating which when dry provides a pleasing appearance. Clearly, the size of the receptacles length, width, depth and orientation have a significant effect on determining the overall pattern obtained.

The invention is illustrated with reference to the drawing which represents a conventional roller-type applicator modified with one form of sleeve according to the invention.

With reference to the drawing, a conventional applicator head 1 can rotate about an axle 2 connected with a handle. The applicator head 1 is surfaced with simulated lambswool. A sleeve 3 covers the surface of simulated lambswool and is retained in position on the applicator head by elasticated ends 4. The sleeve 3 comprises a textile backing 5 to which is attached cord 6 of thickness approximately $\frac{1}{8}$" in a convoluted manner such as to define a plurality of interconnecting receptacles 7 for paint. The textile backing and the attached cord are comprised of a major proportion of cotton. The sleeve 3 provides a structure for forming a tube having an inside diameter of generally the same size as the outside diameter of the applicator head 1, and means are associated with the exterior surface of the structure for providing a plurality of receptacles for thickened paint. The receptacles may be provided by the cord 6 on the backing 5, or by perforations or holes in the structure, as heretofore described.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

I claim:

1. A sleeve for use with a conventional single roller paint roller applicator for modifying the ability of the paint roller comprising: a structure for forming a tube having an inside diameter of generally the same size as the outside diameter of a conventional paint roller, and having an exterior surface; and means associated with the exterior surface of said structure for providing a plurality of receptacles for thickened paint so that when a conventional single roller, over which said sleeve is exteriorly disposed, is disposed in thickened paint so that thickened paint is received by said receptacles, and when said roller with exteriorly disposed sleeve is moved along a substrate, thickened paint is expressed from the receptacles onto the substrate to provide a definite pattern of thickened paint on the substrate.

2. A sleeve as recited in claim 1 further comprising one or more tie strings or elasticated ends for attaching said sleeve to a roller.

3. A sleeve as recited in claim 1 wherein said means associated with the exterior surface comprises perforations or holes provided in said structure.

4. A sleeve as recited in claim 1 wherein said structure comprises a perforated tube of plastics material.

5. A sleeve as recited in claim 1 wherein said structure comprises a backing and wherein said means associated with the exterior surface of said structure comprises a cord attached to said backing and extending along the exterior surface thereof in a convoluted manner.

6. A method of producing a textured or patterned effect on a substrate with thickened paint; and utilizing a conventional single roller paint roller, and a sleeve adapted to be disposed over the paint roller and having a plurality of receptacles arranged in a predetermined pattern on the exterior surface thereof; said method comprising the steps of disposing the sleeve on the conventional paint roller so that the receptacles are disposed exteriorly of the conventional paint roller;

disposing the sleeve-covered roller into operative association with thickened paint so that thickened paint is received by the receptacles; and moving the roller along a substrate so that thickened paint is expressed from the receptacles onto the substrate to provide a definite patterned or textured effect on the substrate.

7. A method as recited in claim 6 comprising the further step of constructing the sleeve by weaving.

8. A method as recited in claim 6 comprising the further step of constructing the sleeve by knitting.

9. A method as recited in claim 6 comprising the further step of constructing the sleeve by crocheting.

10. A method as recited in claim 6 comprising the further step of constructing the sleeve by a netting process.

11. A method as recited in claim 6 comprising the further step of constructing the sleeve by an expanding process.

12. A method as recited in claim 6 comprising the further step of constructing the receptacles in the sleeve as perforations or holes in a sleeve structure adapted to be provided as a tube over the conventional roller.

13. A method as recited in claim 6 comprising the further step of constructing the sleeve by providing a backing, and attaching to the backing in a convoluted manner a cord to provide the receptacles.

14. An assembly comprising: a single roller paint roller applicator having an exterior surface; a sleeve disposed over the exterior surface of said single roller; said sleeve comprising a structure for forming a tube having an inside diameter of generally the same size as the outside diameter of said paint roller exterior surface, the structure also having an exterior surface; and means associated with the exterior surface of said structure for providing a plurality of receptacles for thickened paint, so that when said roller is disposed in thickened paint, thickened paint will be received by said receptacles, and when said roller is moved along a substrate thickened paint will be expressed from the receptacles onto the substrate to provide definite pattern of thickened paint on the substrate.

* * * * *